US008769963B2

(12) United States Patent
Ryan

(10) Patent No.: US 8,769,963 B2
(45) Date of Patent: Jul. 8, 2014

(54) LOW LEAKAGE SPRING CLIP/RING COMBINATIONS FOR GAS TURBINE ENGINE

(75) Inventor: William R. Ryan, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1798 days.

(21) Appl. No.: 11/699,958

(22) Filed: Jan. 30, 2007

(65) Prior Publication Data

US 2008/0179837 A1 Jul. 31, 2008

(51) Int. Cl.
*F02C 7/20* (2006.01)
*F01D 9/02* (2006.01)
*F23R 3/60* (2006.01)

(52) U.S. Cl.
CPC . *F01D 9/023* (2013.01); *F23R 3/60* (2013.01); *F23R 2900/00012* (2013.01); *F23D 2214/00* (2013.01)
USPC ..... 60/800; 60/752; 60/757

(58) Field of Classification Search
CPC ..... F01D 9/023
USPC ..... 60/722, 796, 798, 800, 752–760, 799; 277/602; 285/319
See application file for complete search history.

(56) References Cited

U.S. PATENT DOCUMENTS 2,206,110 A * 7/1940 Myers et al. ..... 188/315
2,581,999 A * 1/1952 Blatz ..... 60/756
3,759,038 A * 9/1973 Scalzo et al. ..... 60/800
4,192,051 A * 3/1980 Bergeron ..... 29/888.075
4,232,527 A 11/1980 Reider
4,719,748 A * 1/1988 Davis et al. ..... 60/39.37
4,896,499 A * 1/1990 Rice ..... 60/792
5,987,879 A * 11/1999 Ono ..... 60/800
6,425,240 B1 * 7/2002 Park ..... 60/39.23
6,453,675 B1 * 9/2002 Royle ..... 60/800
6,571,560 B2 * 6/2003 Tatsumi et al. ..... 60/753
6,869,082 B2 3/2005 Parker
6,880,341 B2 4/2005 Parkman et al.
7,007,482 B2 3/2006 Green et al.
7,082,766 B1 * 8/2006 Widener et al. ..... 60/752
7,096,668 B2 * 8/2006 Martling et al. ..... 60/757
7,524,167 B2 * 4/2009 Ohri et al. ..... 415/215.1
7,647,779 B2 * 1/2010 Shi et al. ..... 60/800
2005/0132708 A1 * 6/2005 Martling et al. ..... 60/752
2005/0262844 A1 * 12/2005 Green et al. ..... 60/752
2006/0242965 A1 * 11/2006 Shi et al. ..... 60/796

* cited by examiner

*Primary Examiner* — William H Rodriguez
*Assistant Examiner* — Lorne Meade

(57) ABSTRACT

A combustor-to-transition seal (301) includes a spring clip assembly (322, 422, 522) and a first spring metal ring (340, 441) or a ring assembly (440,540) that includes the first spring metal ring (441) and a second spring metal ring (442). Such combustor-to-transition seal (301) provides a first seal (321) and a second seal (331, 531) when at a junction of a combustor (108, 308, 508) and a transition (114, 314, 514). In an embodiment, the first spring metal ring (340) has a plurality of apertures (342) through the ring (340) that provide effusion cooling of the ring (340). The plurality of apertures (342) regulates a flow of cooling fluid to maintain an acceptable temperature of the ring (340). In an alternative embodiment, the second spring metal ring (442) has grooves (446) that regulate a flow of cooling fluid to maintain an acceptable temperature of the ring assembly (440).

17 Claims, 5 Drawing Sheets

LOW LEAKAGE SPRING CLIP/RING COMBINATIONS FOR GAS TURBINE ENGINE

BACKGROUND OF THE INVENTION

A modern gas turbine engine, such as is used for generation of electricity at power plants, is a multi-part assembly of various adjacent components, many of which are subjected to mechanical and thermal stresses over long periods of operation. Mechanical stresses to various components result from one or more of vibrational, low cycle (and other thermally related), and other types of stress contributors. As to direct thermal stresses, operating temperatures in some gas turbine engine combustion chambers may reach or exceed 2,900 degrees Fahrenheit, and components of such combustion chambers are cooled and/or provided with thermal barrier coatings to address exposure to such elevated temperatures.

When cooling is used to maintain a component below a specified temperature, often compressed air from the compressor is diverted to pass through a cooling passage. In "closed cooling" approaches, such air, after cooling, continues to the combustor entrance and joins the major flow of air supplied for combustion and dilution purposes. In "open cooling" approaches, such air enters a hot gas flow path downstream of the combustor and may be less available, or not available, for such primary purposes.

Also, as operating temperatures are elevated, there is a greater concern for effective dilution of the fuel/air combustion mixture to lower the $NO_x$ to reach desired emissions standards. As compressed air is used for cooling components, such as through open cooling of more downstream components, this loss of compressed air that would otherwise enter the combustor may result in higher than desired $NO_x$ emissions.

The junction between the combustor (which generally may be considered to comprise a combustion chamber) and the transition of a gas turbine engine typically has a spring clip assembly that provides for a relatively tight but flexible connection between these components. This connection provides for the combustor/transition assembly to expand and contract as needed, relative to the outer casing, during thermal changes, while also providing a seal between the combustor and the transition. The prior art spring clip assemblies are designed to allow air to flow through such spring clip assemblies and this provides an open type cooling to the spring clips and adjacent components. However, the level and variability of cooling air flow through various existing spring clip assemblies does not provide a level of precision and accuracy for cooling, and consequent cooling efficiency, that is desired for more advanced gas turbine engine systems.

There have been various efforts to improve aspects of the seal between a combustor and a transition of a gas turbine engine. For example, U.S. Pat. No. 6,869,082, issued Mar. 22, 2005 to David M. Parker, teaches an improved spring clip seal in which at least one leaf may include a flared end for limiting gas from passing through slots in the seal of the spring clip. A center sealing member is positioned in at least one embodiment between inner and outer spring clip housings. U.S. Pat. No. 7,007,482, issued Mar. 7, 2006 to A. Green et al., teaches an alternate interface region between a combustion liner and a transition duct. This region comprises feed holes supplying cooling fluid into an annulus and a means for augmenting heat transfer which may comprise geometric ridge configurations. These are stated to help achieve a heat transfer augmentation by turbulating the cooling air to maximize the cooling effectiveness.

Notwithstanding such efforts, a need remains for a seal between a combustor and a transition that provides for more precise and accurate cooling.

BRIEF DESCRIPTION OF THE DRAWINGS

FIG. 3E provides a side partial cut-away view of a combustor joined in operational position with a transition piece bv vet another embodiment of a combustor-to-transition seal of the present invention.

DETAILED DESCRIPTION OF EMBODIMENTS OF THE INVENTION

The present inventor has identified variable leakage to exist at spring clip assemblies at the junction of a combustor and a transition. This may include unit-to-unit variation. It was perceived that resolution to obtain a more precise, desired level of leakage to effectuate cooling, without unneeded losses, could provide additional compressed air to the combustor and provide for lower emissions. Following such identification and analysis the present inventor conceived a more advanced cooling system comprising a spring clip assembly combined with a piston-type spring-metal ring. This solution, exemplified by embodiments described below and depicted in the figures, achieves low and uniform defined leakage that is sufficient to provide a specified level of cooling. Embodiments also provide a desired structural integrity and seal redundancy. The savings in cooling air provides for improved combustion and emissions.

Figure 1A:
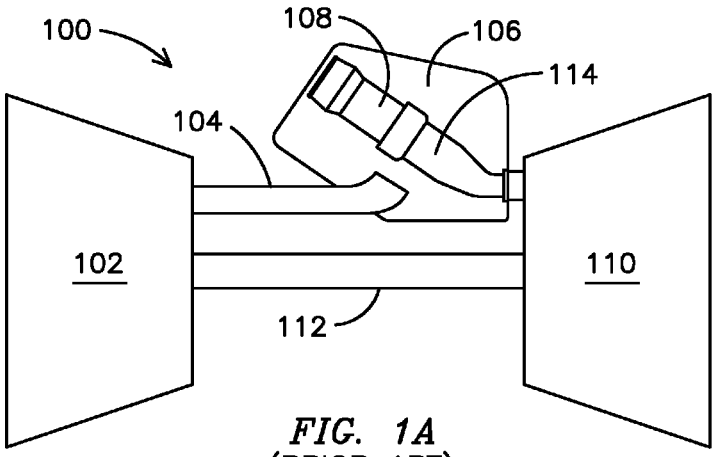
FIG. 1A (PRIOR ART)
FIG. 1A is a schematic depiction of a prior art gas turbine engine.

FIG. 1A provides a schematic cross-sectional depiction of a prior art gas turbine engine 100 such as may comprise various embodiments of the present invention. The gas turbine engine 100 comprises a compressor 102, a combustor 108, and a turbine 110. During operation, in axial flow series, compressor 102 takes in air and provides compressed air to a diffuser 104, which passes the compressed air to a plenum 106 through which the compressed air passes to the combustor 108, which mixes the compressed air with fuel (not shown), after which such mixture combusts, and thereafter largely combusted gases are passed via a transition 114 to the turbine 110, which may generate electricity. A shaft 112 is shown connecting the turbine to drive the compressor 102. Although depicted schematically as a single longitudinal channel, the diffuser 104 extends annularly about the shaft 112 in typical gas turbine engines, as does the plenum 106. Air from the compressor 102 also travels to the turbine 110 and other components by various channels (not shown in FIG. 1) to provide higher pressure air that surrounds and may enter the hot gas path for cooling.

Figure 1B:
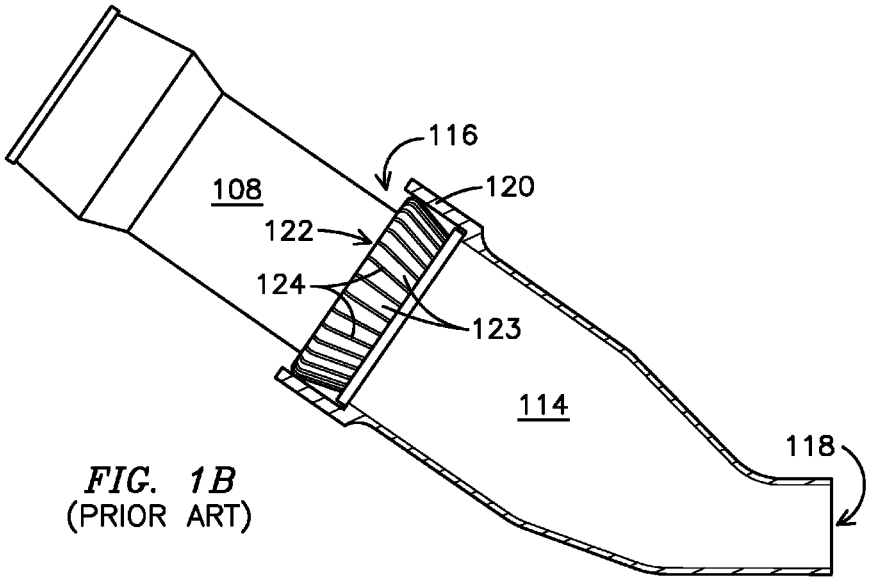
FIG. 1B (PRIOR ART)
FIG. 1B is a side partial cut-away view of a particular prior art combustor and transition as may be found in the prior art gas turbine engine of FIG. 1A, showing an assembly of spring clips positioned to seal the junction of these components.

FIG. 1B provides a side partial cut-away view of the prior art combustor 108 of FIG. 1A joined in operational position with the prior art transition 114. The transition 114 has an upstream end 116, and a downstream end 118 that connects to an entrance of a turbine (not shown). The upstream end 116 has a circumferentially extending transition inlet ring 120 which is disposed over an assembly 122 of spring clip leaves 123. Slots 124 formed by methods as known to those skilled in the art are formed between adjacent spring clip leaves 123

For a prior art spring clip assembly such as 122 of FIG. 1B, spring clip leaves such as 123 are produced by expanding two concentric cylinders into the spring clip profile. Once the profiles are formed, slots between individual spring clip leaves are formed such as by laser-machining. To lessen leakage, the inner and outer layers of spring clip leaves 123 are rotated relative to one another so that the slots do not align. Notwithstanding this approach, three sources of leakage are recognized to remain: 1) axial misalignment between the inner and outer layers produces a leak path running the entire length of the spring clip leaf; 2) leakage through the slots, even when offset by the rotation; and 3) leakage at the interface of the leaves at the contact region with the transition inlet ring. It has particularly been recognized that type 1 leakage, between the inner and outer leaves, is difficult to control and small changes in their positional relationship can result in large leakage flow variations. It is noted that although referred to as assemblies of spring clips herein, these alternatively are referred to as "housings," such as an inner housing and an outer housing, by some in the art.

Figure 2:
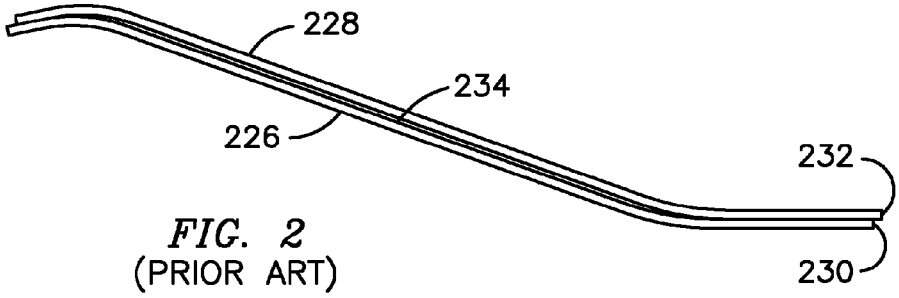
FIG. 2 (PRIOR ART)
FIG. 2 depicts a side cross-sectional view of two spring clips of a prior art assembly of spring clips in which an axial misalignment results in a leakage gap.

FIG. 2 provides a schematic cross sectional view of an inner spring clip leaf 226 and an outer spring clip leaf 228 that are in slight axial misalignment (as judged by ends 230 and 232), resulting in a leakage gap 234 between the leaves 226 and 228. This visually demonstrates the axial misalignment discussed above.

Figure 3E:
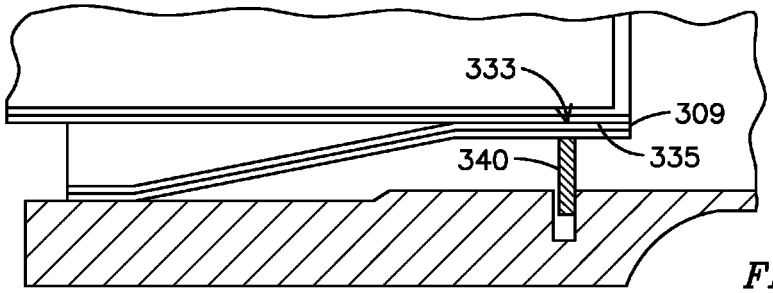
FIG. 3E provides a side partial cut-away view of a combustor joined in operational position with a transition piece by yet another embodiment of a combustor-to-transition seal of the present invention.
Figure 3B:
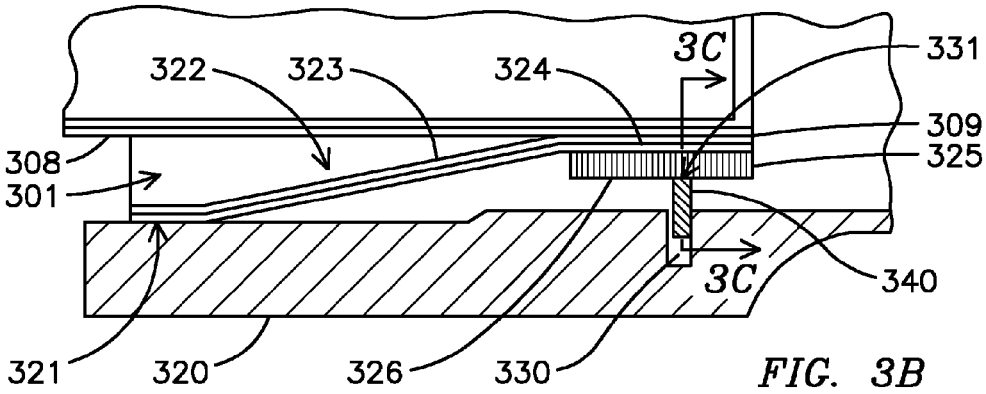
FIG. 3B provides a magnified cross-sectional view of the encircled area of FIG. 3A.
Figure 3C:
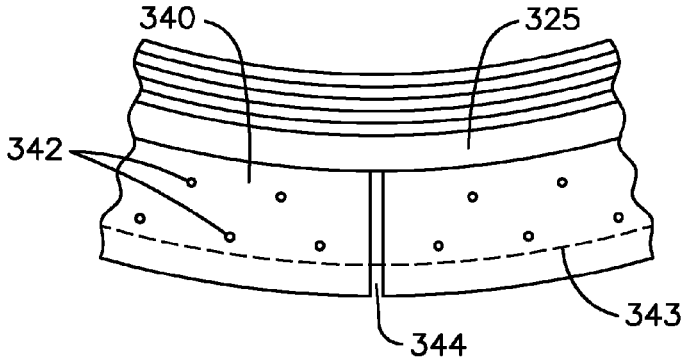
FIG. 3C provides plane view of the components taken along line C-C of FIG. 3B, particularly depicting a gap in the spring metal ring.
Figure 3D:
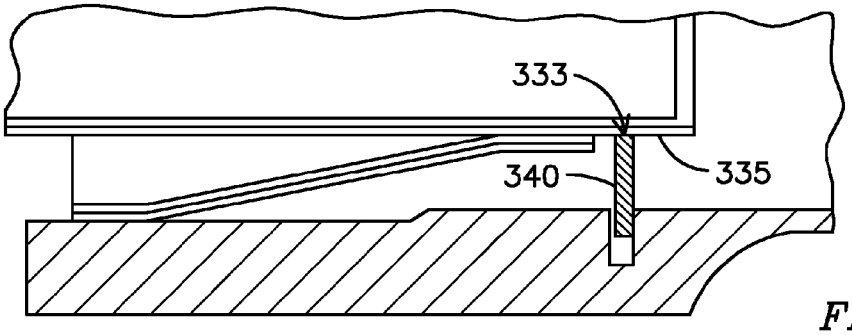
FIG. 3D provides a side partial cut-away view of a combustor joined in operational position with a transition piece by another embodiment of a combustor-to-transition seal of the present invention.
Figure 3A:
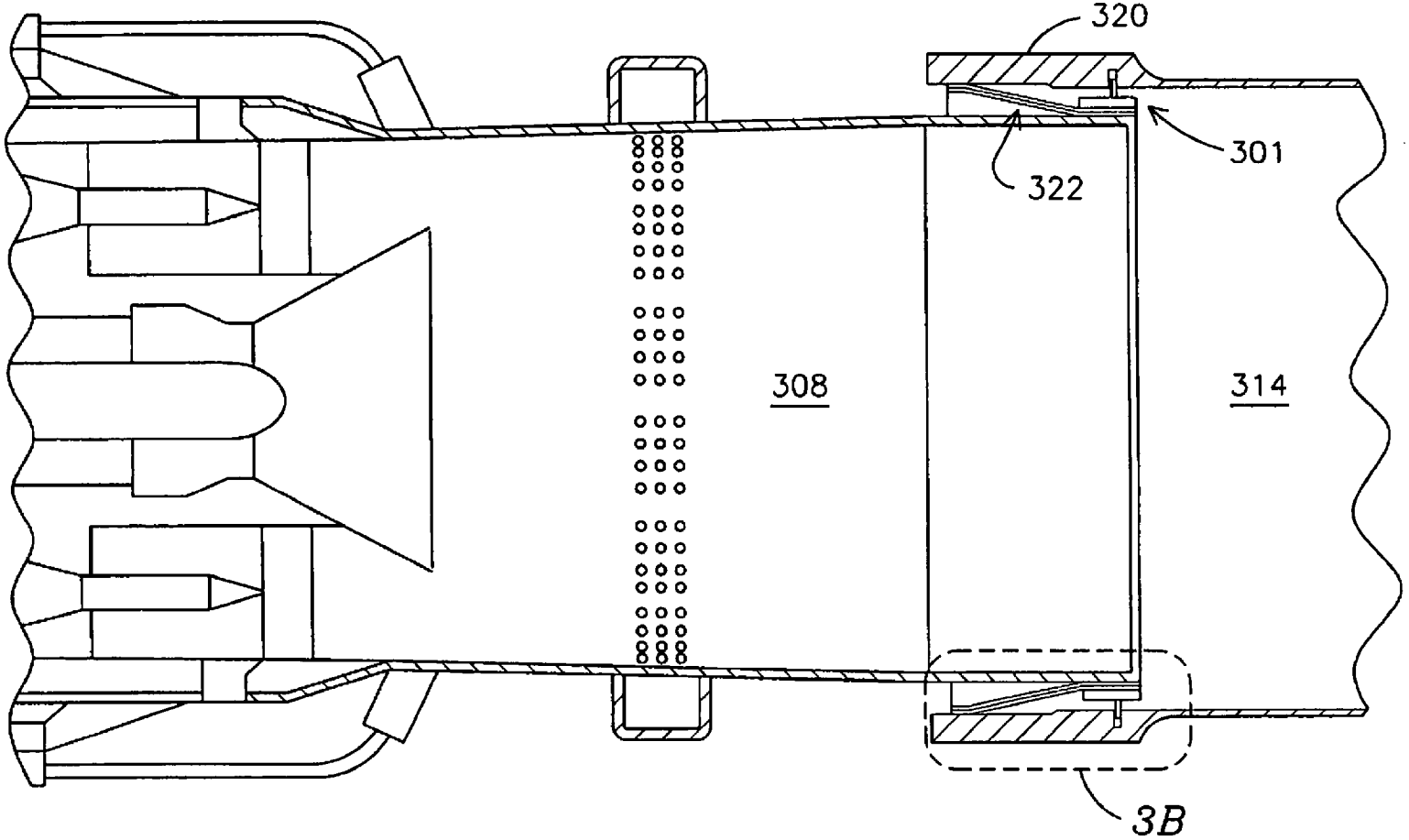
FIG. 3A provides a side partial cut-away view of a combustor joined in operational position with a transition piece by one embodiment of a combustor-to-transition seal of the present invention.

FIGS. 3A and 3B depict one embodiment of a combustor-to-transition seal 301 the present invention. FIG. 3A provides a cross-sectional side view of a combustor 308, and a partial representation of a transition 314. Transition inlet ring 320 is shown surrounding a spring clip assembly 322. FIG. 3B provides an enlarged view of the encircled area of FIG. 3A to show in greater detail aspects of this embodiment.

As more clearly viewable in FIG. 3B, combustor-to-transition seal 301 comprises the spring clip assembly 322 and a spring-metal ring 340. Spring clip assembly 322 itself comprises angled leaf springs 323 which comprise a flattened section 324 that is spot welded to attach to combustor 308 at its downstream end 309. As is known to be practiced in the art, the spring clip assembly 322 comprises inner and outer layers (see FIG. 3B) having slots (not shown, see FIG. 1B) between individual leaf springs 323, wherein the slots of the inner layer are offset to the slots of the outer layer. As for spring clip assemblies in general, the free ends of the leaf springs 323 bear against an opposing surface (here, the inside surface of the transition inlet ring 320) so that the spring clip assembly 322 provides vibration damping and mutual support to the combustor and the transition based on the spring bias force between the leaf springs 323, which are fixedly attached to the combustor 308 and the transition inlet ring 320. This provides a first seal shown as 321. Additionally, it is noted that a flow of cooling fluid, such as compressed air, passes through the spring clip assembly through various routes (see above). However, as noted elsewhere, there is not effective nor sufficient regulation of such flow.

An optional sealing member 325 comprises a sealing surface 326. The sealing surface 326 is sufficiently long (from upstream to downstream ends) to accommodate the relative motion between the combustor 308 and the transition inlet ring 320. A partial slot 330 (distinguished from slots of the spring clip assembly 322) is provided in the transition inlet ring 320 to accommodate a spring-metal ring 340 having physical characteristics of a piston ring. Such ring 340 may be made of cast iron, nodular cast iron, steel, or other materials as are known in the art. After installation, the ring 340 has a bias to compress against the sealing surface 326 to achieve a sealing function, forming a second seal shown as 331. During operation, as the combustor 308 may move relative to the transition 314, the ring 340 slides along sealing surface 326. A desired and defined level of leakage of cooling fluid (e.g., compressed air) through the ring is provided, such as by defined passages through the ring 340. By "defined passages" is meant spaced apart holes, grooves, or other apertures or channels of a known dimension that do not appreciably change in dimension after initial formation. FIG. 3C, a partial view of the section along line C-C of FIG. 3B, shows one arrangement, not to be limiting, of a plurality of apertures 342 through ring 340 that provide effusion cooling of the ring 340. This is but one example of defined passages. Dashed line 343 indicates the height to which the transition inlet ring (not shown, see FIG. 3B) extends along ring 340. It is noted that a gap 344 of the ring 340 may be present, may be minimized, or may be eliminated by use of gapless ring technologies as are known to those skilled in the art. Particularly for a single-ring embodiment such as depicted in FIGS. 3A-3C, the dimensions of such gap 344 are minimized so as to reduce leakage through such gap 344.

Such embodiment demonstrates several advantages of the present invention, including: 1) the leakage level is determined by defined passages in a spring-metal ring and not by leakage through the spring clip assembly; 2) the spring clip assembly maintains alignment, structural support, and force damping (without its non-uniformity and/or wear substantially contributing to undesired and variable leakage of cooling air); 3) the spring-metal ring shields the spring clip assembly from hot post-combustion gases, thereby improving the latter's mechanical properties and life; and 4) the redundancy of having two sealing components provides that partial or complete failure of one could occur and the other could still control leakage to an extent. As can be seen in another embodiment shown in FIG. 3D, spring-metal ring 340 may instead form a second seal 333 against a radially outer surface 335 of the combustor 308. As can be seen in still another embodiment shown in FIG. 3E, spring-metal ring 340 may instead form a second seal 333 against a radially outer surface of a downstream end 309 of the spring clip assembly 322.

Figure 4A:
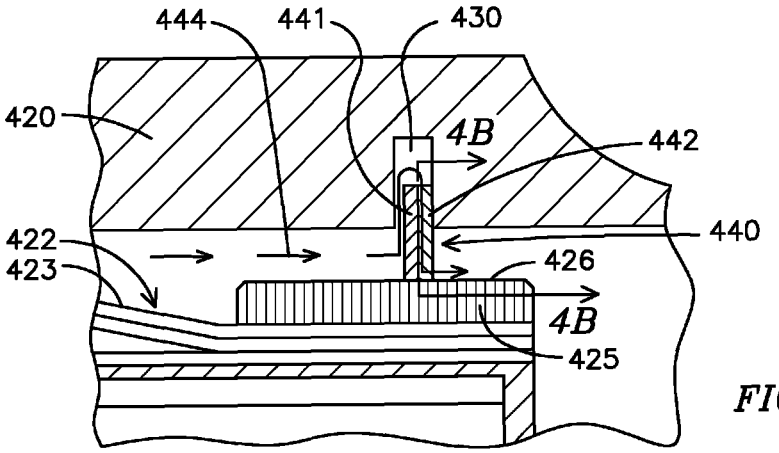
FIG. 4A shows a side cross-sectional view similar to FIG. 3B, depicting a defined leakage combustor-to-transition seal of the present invention in which a ring assembly has two rings.
Figure 4C:
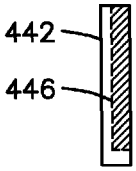
FIG. 4C, a side view taken along line C-C of FIG. 4B, depicts a defined passage for cooling air in a groove of the ring.
Figure 4B:
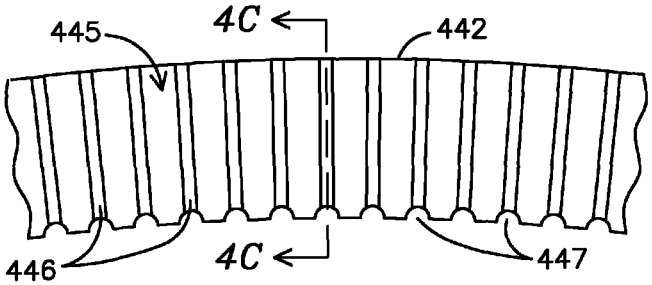
FIG. 4B, taken along line B-B of FIG. 4A, provides a plane view of the inside surface of one ring.

A fifth advantage, related to cooling the ring by providing a controlled flow of air through the ring, is exemplified by the embodiment of FIGS. 4A-C, which is not meant to be limiting. FIG. 4A shows a side cross-sectional view similar to FIG. 3B, however clearly indicating that a ring assembly 440 has a first ring 441 and a second ring 442 joined thereto. Further, in FIG. 4A, like-numbered components generally represent components described for FIGS. 3A-C. A curved arrow 444 shows a flow of cooling air passing between first ring 441 and second ring 442 toward the hot gas path within the transition (not shown in entirety, see FIG. 3A). FIG. 4B, a section taken along lines B-B in FIG. 4A, shows a partial interior face 445 of second ring 442 with a plurality of cooling grooves 446 formed therein. An optional scalloped edge 447 also is shown. When the first ring 441 (see FIG. 4A) and the second ring 442 of ring assembly 440 are joined and in place, cooling air as shown by arrow 444 in FIG. 4A passes through the cooling grooves 446, cooling the ring assembly 440, and exiting through openings along the scalloped edge 447. Thus, this provides a second example, not to be limiting, of defined passages as that term is used herein. The dimensions of the cooling grooves 446 determine, at least in part (also considering operational flow rates, pressures, obstructions and back pressure, etc.) the extent of defined leakage that is sufficient to provide a specified level of cooling to the rings 441 and 442. Thus, as used herein, the term "defined leakage" refers to a passive control related to the provision of the defined passages to regulate flow, where the defined passages are provided between two adjacent rings that form a seal against a sealing surface. This is in contrast to an approach to regulate leakage that is by an ongoing varying adjustment of flow rate such as by periodically modifying a valve opening in a flow path. It is noted that as used herein, "cooling fluid," "cooling air flow" and the like may be taken to mean a fluid or a flow that may result in cooling one or more of the rings, portions of the combustor and/or transition, and spring leaves.

FIG. 4C provides a side cross-sectional view of the second ring 442 taken at line C-C of FIG. 4B. This shows the groove 446 that provides a defined passage for the cooling air.

Thus, this approach to cooling assures a controlled, desired level of cooling to the ring assembly 440; the cooling air passing by the spring clip assembly 422 (only shown in part) also provides cooling to this component. Sealing surface 426 also may be cooled by the flow of cooling air exiting from the cooling passages 447.

Overlapping of adjacent ends of these rings may be achieved by methods known to those skilled in the art. This prevents a gap of one ring directly aligned with a gap in a second ring. Referring to FIG. 4B for instance, in various embodiments the first ring 441 and the second ring 442 are joined together, such as by a spot weld, pin, or other means known to those skilled in the art, so that their respective gaps (not shown) do not overlap. The overlap of one gap relative to a second gap may place the two gaps at 90 degrees apart, or 180 degrees apart, or another position. Ring sets having offset orientations such as these are termed "offset defined leakage ring sets." One approach to achieve the offset is taught by U.S. Pat. No. 4,192,051, issued Mar. 11, 1980 to A. Bergeron. This patent is incorporated by reference for its teachings related to such attachment.

Anti-rotation features as are known to those skilled in the art may be provided to the rings of the present invention in some embodiments. Also, various embodiments may be practiced without (as shown herein), or with, biasing springs. An example of a biasing spring used in a floating collar for a fuel nozzle is provided in U.S. Pat. No. 6,880,341, issued to K. Parkman and S. Oskooei on Apr. 19, 2005.

The sealing surface 326, 426 shown in FIGS. 3A, 3B, and 4A is an optional component. In various embodiments the sealing surface, such as 326 and 426, is formed by applying a metal strip (as is represented in FIG. 3A, 3B by the more generic sealing member 325) over the flattened section (see 324 in FIG. 3B) of the spring clip assembly and then rounding this strip, such as with a lathe. This is designed to achieve a desired roundness to the surface contacting the ring(s), to provide a sealing surface of desired circular uniformity for interfacing the ring(s) used in the defined leakage combustor-to-transition seal. It is noted that when such metal strip or other sealing member is not utilized, a sealing surface is provided by a surface, preferably sufficiently smooth and rounded, of the component against which the ring bears when installed and exerting its biasing force.

Figure 5B:
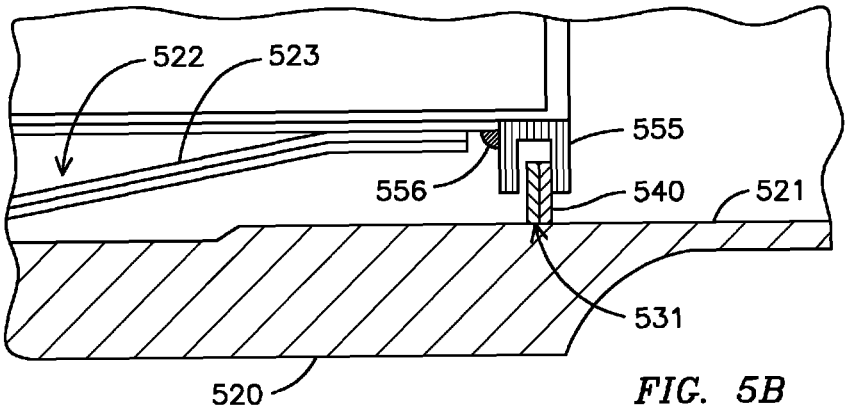
FIG. 5B provides a magnified cross-sectional view of the encircled area of FIG. 5A.
Figure 5A:
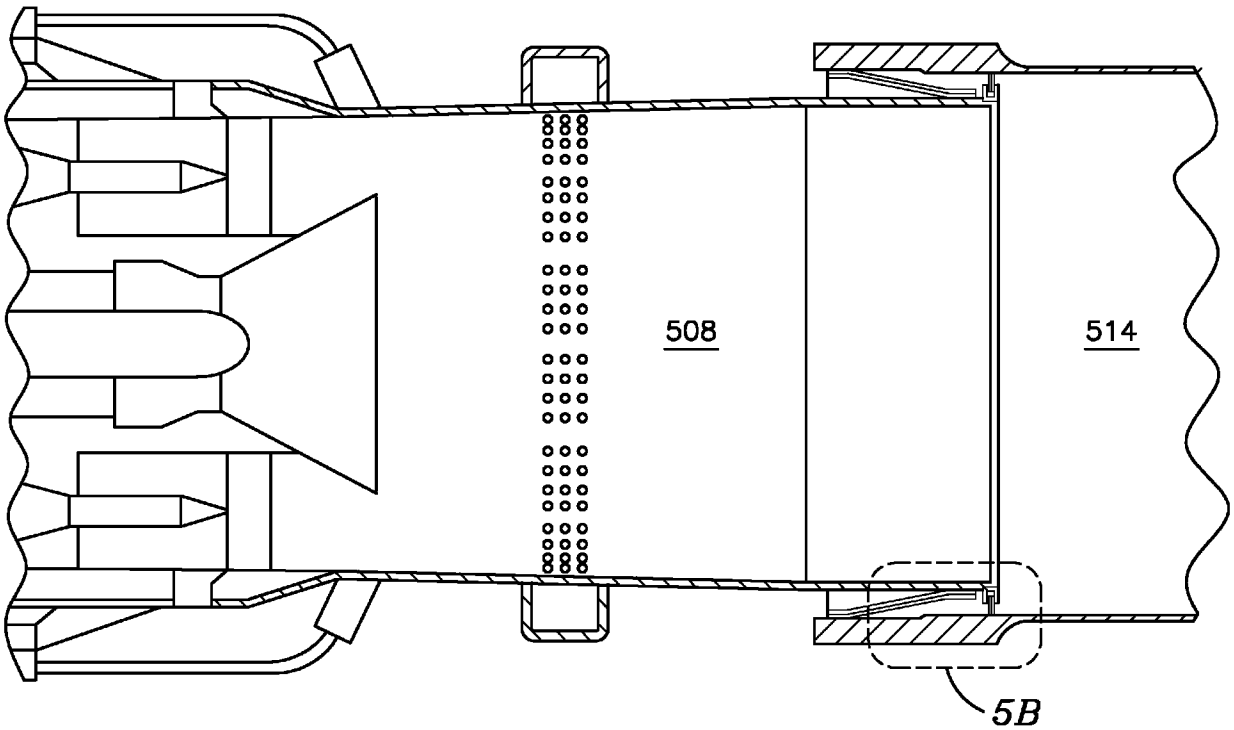
FIG. 5A provides a side partial cut-away view of a combustor joined in operational position with a transition piece by another embodiment of a defined leakage combustor-to-transition seal of the present invention.

FIGS. 5A and 5B provide an alternative embodiment. Here an interior surface 521 of transition ring 520 provides a sealing surface of desired circular uniformity for interfacing ring (s) used in the spring clip/ring assembly. One or more metallic spring-metal rings 540 are held in place by a U-shaped retainer 555. Further, in FIGS. 5A and 5B, like-numbered components generally represent components described for FIGS. 3A-C. In the embodiment of FIGS. 5A and 5B, the one or more spring-metal rings 540 are sized and/or biased to be urged outward to seal the space between the one or more rings 540 and the interior surface 521 of transition ring 520. A seal 531 forms at the contact surface of the ring 540 and the transition ring interior surface 521. The U-shaped retainer 555 may be attached by any means known in the art; a weld 556 that is shown is exemplary. Also, to achieve this orientation of ring to combustor and transition, functional equivalents of the U-shaped retainer, such as may be constructed by those of ordinary skill in the art, may be provided in place of the U-shaped retainer that is depicted in FIGS. 5A and 5B.

It is appreciated that another aspect of the ring(s) forming the second seal (specifically indicated as 331 and 531 in FIGS. 3B and 5B, respectively, and represented in other figures as well) is that a contacting along a contacting side (front or rear) of the respective ring also provides a sealing function that supports the effectiveness of the second seal. For example, considering FIG. 3B, a portion of the ring 340 may contact a front or a rear wall of the partial slot 330 and prevent passage of a flow of cooling fluid by such sealing contact. Under typical operations the force of the flow of cooling fluid, from outside the combustor into the transition through the first and second seals as defined herein, is sufficient to force the rings downstream against a surface to ensure such sealing function.

Although the embodiments depicted in the figures all provide a spring clip assembly that is attached, such as by welding, to the combustor downstream end, it is appreciated that various embodiments may have an attachment of the spring clips to the transition, such as to the transition inlet ring, with the free end of the leaf springs bearing against a portion of the outside wall of the combustor. Such embodiments are meant to be included within the scope of the claims provided herein.

All patents, patent applications, patent publications, and other publications referenced herein are hereby incorporated by reference in this application in order to more fully describe the state of the art to which the present invention pertains, and to provide such teachings as are generally known to those skilled in the art.

Accordingly, many modifications and other embodiments of the invention will come to the mind of one skilled in the art having the benefit of the teachings presented in the foregoing descriptions, the associated drawings, and the additional disclosures. Therefore, it is to be understood that the invention is not to be limited to the specific embodiments disclosed, and that other modifications and embodiments are intended to be included within the spirit and purview of this application and the scope of the appended claims.

The invention claimed is:

1. A combustor-to-transition seal comprising:

a spring clip assembly comprising a circular arrangement of leaf springs adapted to provide a first seal between a combustor and a transition, effective to provide mutual support to the combustor and the transition, and to allow a flow of cooling fluid to pass through the spring clip assembly; and a first spring metal ring positioned downstream of the leaf springs, between the combustor and the transition and biased against a sealing surface to form a second seal between the combustor and the transition, the first spring metal ring comprising a plurality of defined passages effective to regulate the flow of cooling fluid there through and to cool the first spring metal ring, wherein the first spring metal ring is positioned partially within a partial slot, wherein the combustor-to-transition seal is configured to permit relative radial motion between the combustor and the transition, and the relative radial motion between the combustor and the transition results in relative radial motion between the sealing surface and the partial slot, and wherein the first spring metal ring is free to move radially within the partial slot to accommodate the relative radial motion.

2. The combustor-to-transition seal of claim 1, wherein the spring clip assembly comprises an inner layer and an outer layer of leaf springs, each layer having respective slots between adjacent leaf springs, the slots of the inner layer being offset to the slots of the outer layer, wherein the spring clip assembly is attached to the combustor and wherein the partial slot is disposed in a transition inlet ring.

3. The combustor-to-transition seal of claim 2, wherein apertures through the first spring metal ring are the plurality of defined passages.

4. The combustor-to-transition seal of claim 3, wherein a sealing member, comprising the sealing surface, is provided between the combustor and the first spring metal ring, and wherein the sealing surface is disposed on a radially outer surface of the sealing member and is in sealing contact with the first spring metal ring.

5. The combustor-to-transition seal of claim 1, comprising a ring assembly comprising the first spring metal ring and a second spring metal ring, the second spring metal ring comprising a plurality of grooves, wherein the plurality of grooves cooperate together with the first spring metal ring to define the plurality of defined passages.

6. The combustor-to-transition seal of claim 5, wherein the partial slot is disposed in a transition inlet ring.

7. The combustor-to-transition seal of claim 5, wherein the partial slot is formed by a U-shaped retainer attached to the combustor.

8. The combustor-to-transition seal of claim 5, wherein a sealing member, comprising the sealing surface is provided between the combustor and the first spring metal ring, and wherein the sealing surface is disposed on a radially outer surface of the sealing member and is in sealing contact with the first spring metal ring.

9. The combustor-to-transition seal of claim 8, wherein the ring assembly is an offset defined leakage ring set wherein the first spring metal ring and the second spring metal ring each comprises a circumferential gap and the circumferential gaps are circumferentially offset from each other.

10. The combustor-to-transition seal of claim 1, wherein the spring clip assembly is attached to the combustor and the partial slot is formed by a U-shaped retainer attached to the combustor.

11. The combustor-to-transition seal of claim 10, comprising a ring assembly comprising the first spring metal ring and a second spring metal ring, the second spring metal ring comprising a plurality of grooves, wherein the plurality of grooves operate together with the first spring metal ring to define the plurality of defined passages.

12. A gas turbine engine comprising the combustor-to-transition seal of claim 1.

13. A gas turbine engine comprising the combustor-to-transition seal of claim 11.

14. The combustor-to-transition seal of claim 1, wherein a radially outer surface of a downstream end of the spring clip assembly comprises the sealing surface in sealing contact with the first spring metal ring.

15. The combustor-to-transition seal of claim 1, wherein a radially outer surface of the combustor comprises the sealing surface in sealing contact with the first spring metal ring.

16. A combustor-to-transition seal comprising:

a spring clip assembly comprising a circular arrangement of leaf springs adapted to provide a first seal between a combustor and a transition, the spring clip assembly comprising an inner layer and an outer layer of said leaf springs, each layer having respective slots between adjacent leaf springs, the slots of the inner layer being offset to the slots of the outer layer, wherein the spring clip assembly is attached to the combustor and is effective to mutually support the combustor and the transition and to allow a flow of cooling fluid to pass through the spring clip assembly;

a sealing member, positioned on a radially outer surface of the spring clip assembly and comprising a sealing surface; and a ring assembly, positioned downstream of the spring leaves, in contact with the sealing surface, and partially within a partial slot in a transition inlet ring, comprising a first spring metal ring and a second spring metal ring, each said spring metal ring comprising a circumferential gap, the respective circumferential gaps being circumferentially offset one to the other, the second spring metal ring comprising a plurality of grooves, wherein the plurality of grooves abut the first spring metal ring and are effective to regulate the flow of cooling fluid there through and to cool the ring assembly;

wherein the first and the second spring metal rings are biased toward the sealing surface to form a second seal against the sealing surface, wherein the combustor-to-transition seal is configured to permit relative radial motion between the combustor and the transition, and wherein the first spring metal ring is free to move radially within the partial slot to accommodate the relative radial motion.

17. A combustor-to-transition seal comprising:

a spring clip assembly comprising a circular arrangement of leaf springs adapted to provide a first seal between a combustor and a transition, the spring clip assembly comprising an inner layer and an outer layer of said leaf springs, each layer having respective slots between adjacent leaf springs, the slots of the inner layer being offset to the slots of the outer layer, wherein the spring clip assembly is attached to the combustor and is effective to mutually support the combustor and the transition and to allow a flow of cooling fluid to pass through the spring clip assembly;

a ring assembly, positioned downstream of the spring leaves and partially within a U-shaped retainer attached to the combustor, comprising a first spring metal ring and a second spring metal ring, each said spring metal ring comprising a gap, the respective gaps offset one to the other, the second spring metal ring comprising a plurality of grooves, wherein the plurality of grooves are oriented toward the first spring metal ring and the flow of cooling fluid passes through the plurality of grooves, the grooves effective to regulate the flow of cooling fluid there through and to cool the ring assembly;

wherein the first spring metal ring and the second spring metal ring are biased against an inner surface of the transition to form a second seal, wherein the combustor-to-transition seal is configured to permit relative radial motion between the combustor and the transition, and wherein the first spring metal ring and the second spring metal ring are free to move radially within the U-shaped retainer to accommodate the relative radial motion.

* * * * *